US008109481B2

(12) United States Patent
Suzuki et al.

(10) Patent No.: US 8,109,481 B2
(45) Date of Patent: Feb. 7, 2012

(54) OPERATION DEVICE AND IMAGE RECORDING DEVICE

(75) Inventors: Ryohei Suzuki, Nagoya (JP); Mamoru Namba, Nagoya (JP); Teruo Deshimaru, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 648 days.

(21) Appl. No.: 12/256,430

(22) Filed: Oct. 22, 2008

(65) Prior Publication Data

US 2009/0103251 A1 Apr. 23, 2009

(30) Foreign Application Priority Data

Oct. 22, 2007 (JP) ..... 2007-274067

(51) Int. Cl.
*E04G 3/00* (2006.01)

(52) U.S. Cl. ..... 248/274.1; 248/200

(58) Field of Classification Search ..... 235/462; 248/274.1, 923

See application file for complete search history.

(56) References Cited

U.S. PATENT DOCUMENTS

| | | | | |
|---|---|---|---|---|
| 6,085,972 | A * | 7/2000 | Wright | 235/375 |
| 2003/0174834 | A1 | 9/2003 | Kida | |
| 2005/0061937 | A1 * | 3/2005 | Kim | 248/274.1 |
| 2006/0219852 | A1 | 10/2006 | Kawai et al. | |
| 2007/0024924 | A1 | 2/2007 | Ikeno et al. | |

FOREIGN PATENT DOCUMENTS

| | | | |
|---|---|---|---|
| JP | H10-063192 | A | 3/1998 |
| JP | H11-354941 | A | 12/1999 |
| JP | 2003-274070 | A | 9/2003 |
| JP | 2005189514 | A | 7/2005 |
| JP | 2005-240971 | A | 9/2005 |
| JP | 2006-262040 | A | 9/2006 |
| JP | 2007-036605 | A | 2/2007 |
| JP | 2007-147938 | A | 6/2007 |

OTHER PUBLICATIONS

Japan Patent Office, Notification of Reason for Refusal for Japanese Patent Application No. 2007-274067 (counterpart to above-captioned patent application), mailed Sep. 6, 2011.

* cited by examiner

*Primary Examiner* — Daniel Hess
*Assistant Examiner* — Matthew Mikels
(74) *Attorney, Agent, or Firm* — Baker Botts L.L.P.

(57) ABSTRACT

An operation device includes a rotatable operation panel and a tilt mechanism including a recessed groove and pawl member capable of engaging with the recessed groove and an urging member configured to elastically urge the pawl member. In the engaging state, the pawl member contacts with the recessed groove at a first position and a second position. A relationship $0° < \theta 1 < \theta 2 < 90°$ is satisfied, where, in cross-section orthogonal to the rotation axis, an angle $\theta 1$ is defined between: a first imaginary line connecting the first position and a rotation axis; and a second imaginary line along an inclined surface of the first position side in the recessed groove, and an angle $\theta 2$ is defined between: a third imaginary line connecting the second position and the rotation axis; and a fourth imaginary line along an inclined surface of the second position side in the recessed groove.

11 Claims, 8 Drawing Sheets

OPERATION DEVICE AND IMAGE RECORDING DEVICE

CROSS-REFERENCE TO RELATED APPLICATIONS

This application is based upon and claims priority from Japanese Patent Application No. 2007-274067 filed on Oct. 22, 2007, the entire contents of which are incorporated herein by reference.

TECHNICAL FIELD

The present invention relates to an operation device including an operation panel body rotatably disposed at a main body and a tilt mechanism configured to maintain the operation panel body at a desired rotation angle, and an image recording device including the operation device.

BACKGROUND

An operation device including a touch panel or an operation panel having operation buttons is generally provided at a printer, a scanner, a telephone, a facsimile machine, etc. This operation device is desirably arranged on an upper surface of the printer in view of operability of the touch panel or the operation button or a size of the printer.

The operation panel may be operated from the upper side of the device and also operated from the front side of the device. Therefore, when the operation panel faces above, operability from the front side of the device becomes worse. Similarly, when the operation panel faces the front surface side of the device, operability from the upper surface side of the device becomes worse. Therefore, there has been proposed an operation device in which an operation panel is disposed a device body capable of falling and rising with respect to the device body, and a posture of the operation panel can be changed to direct the operation panel in any direction of the upper surface side of the device or the front surface side of the device. Such an operation device includes a mechanism capable of holding the operation panel in any posture, the so-called tilt mechanism.

JP-A-10-63192 describes an angle holding mechanism in a tilt mechanism for holding a display unit at a desired inclination angle. This angle holding mechanism holds the display unit at the desired inclination angle by locking of a rack to a stopper. Also, when a release button of a release portion is pressed and operated, the locking of the rack to the stopper is released, and the display unit can be rotated.

JP-A-11-354941 describes a hinge mechanism in the portable electronic device, in which a mechanism holds a portable electronic device at any angle so as not to move in a direction of closing the portable electronic device by engagement between a ratchet and a latching potion. When the portable electronic device is moved to 90°, the latching portion deviates from a locus of the ratchet and the portable electronic device can be moved in the closed direction.

SUMMARY

According to the mechanisms disclosed in JP-A-10-63192 and JP-A-11-354941, once the display unit is held at a desired inclination angle, the display unit is not rotated even though pressing force by operation is applied to the display unit. In order to fall the display unit, an operation for releasing an engagement mechanism for holding the inclination angle of the display unit is required. Therefore, a user is forced to perform two operations of the release of engagement and the falling of the display unit, which degrades operability.

The invention has been made in consideration of the above circumstances, and an object thereof is to provide a tilt mechanism for maintaining an operation panel body rotatably disposed at a main body at desired rotation angles, in which a posture of an operation panel body can be changed by one action but the operation panel body is resistant to falling even by a pressing operation.

According to an aspect of the invention, there is provided an operation device comprising: a main body; an operation panel body attached to the main body rotatably around a rotation axis, such that a rotation of the operation panel body allows a posture of the operation panel body to change to take a first posture falling with respect to the main body and a second posture rising with respect to the main body, and a tilt mechanism configured to maintain the operation panel body at predetermined rotation angles, wherein the tilt mechanism comprises: a plurality of substantially V-shaped recessed grooves formed at one of the operation panel body and the main body, the recessed grooves recessed in a radial direction of the rotation axis of the operation panel body and arranged along a circumferential direction of the rotation axis; a substantially V-shaped pawl member provided at the other of the operation panel body and the main body, the pawl member configured to engage with and disengage from the recessed groove at a predetermined position of the circumferential direction of the rotation axis; and an urging member provided at the other of the operation panel body and the main body, the urging member configured to elastically urge the pawl member in a direction that the pawl member engages with the recessed groove, wherein, when the pawl member is urged by the urging member and engages with the recessed groove, the pawl member contacts with the recessed groove at a first position and a second position, the first position at which a contact pressure in the recessed groove increases in case where the operation panel body rotates toward the first posture side, and the second position at which a contact pressure in the recessed groove increases in case where the operation panel body rotates toward the second posture side, and wherein a following relationship is satisfied: $0° < \theta 1 < \theta 2 < 90°$ where, in cross-section orthogonal to the rotation axis, an angle $\theta 1$ is defined between: a first imaginary line connecting the first position and the rotation axis; and a second imaginary line along an inclined surface of the first position side in the recessed groove, and an angle $\theta 2$ is defined between: a third imaginary line connecting the second position and the rotation axis; and a fourth imaginary line along an inclined surface of the second position side in the recessed groove.

According to another aspect of the invention, there is provided an image recording device comprising an operation device, said operation device comprising: a main body; an operation panel body attached to the main body rotatably around a rotation axis, such that a rotation of the operation panel body allows a posture of the operation panel body to change to take a first posture falling with respect to the main body and a second posture rising with respect to the main body, and a tilt mechanism configured to maintain the operation panel body at predetermined rotation angles, wherein the tilt mechanism comprises: a plurality of substantially V-shaped recessed grooves formed at one of the operation panel body and the main body, the recessed grooves recessed in a radial direction of the rotation axis of the operation panel body and arranged along a circumferential direction of the rotation axis; a substantially-shaped pawl member provided at the other of the operation panel body and the main body, the pawl member configured to engage with and disengage from the recessed groove at a predetermined position of the circumferential direction of the rotation axis; and an urging member provided at the other of the operation panel body and the main body, the urging member configured to elastically urge the pawl member in a direction that the pawl member engages with the recessed groove, wherein, when the pawl member is urged by the urging member and engages with the recessed groove, the pawl member contacts with the recessed groove at a first position and a second position, the first position at which a contact pressure in the recessed groove increases in case where the operation panel body rotates toward the first posture side, and the second position at which a contact pressure in the recessed groove increases in case where the operation panel body rotates toward the second posture side, and wherein a following relationship is satisfied: $0° < \theta 1 < \theta 2 < 90°$ where, in cross-section orthogonal to the rotation axis, an angle $\theta 1$ is defined between: a first imaginary line connecting the first position and the rotation axis; and a second imaginary line along an inclined surface of the first position side in the recessed groove, and an angle $\theta 2$ is defined between: a third imaginary line connecting the second position and the rotation axis; and a fourth imaginary line along an inclined surface of the second position side in the recessed groove.

DESCRIPTION

An embodiment of the invention will hereinafter be described properly with reference to the drawings. In addition, the present embodiment is only one example of the invention and needless to say, the embodiment can properly be changed without departing from the scope of the invention.

[Description of Drawings]

Figure 1:
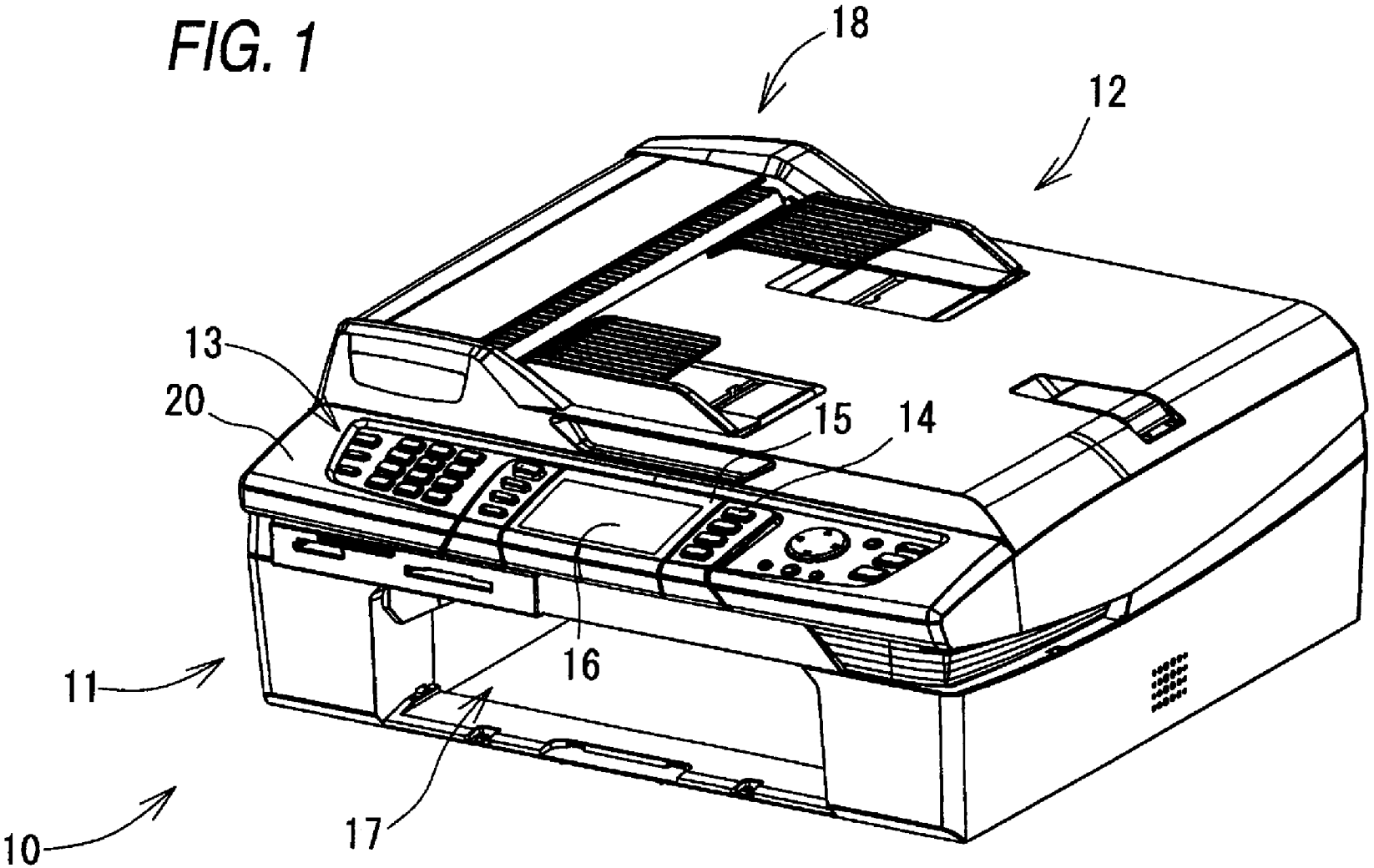
FIG. 1 is a perspective view showing an appearance configuration of a multi function device according to an embodiment of the invention.
Figure 2:
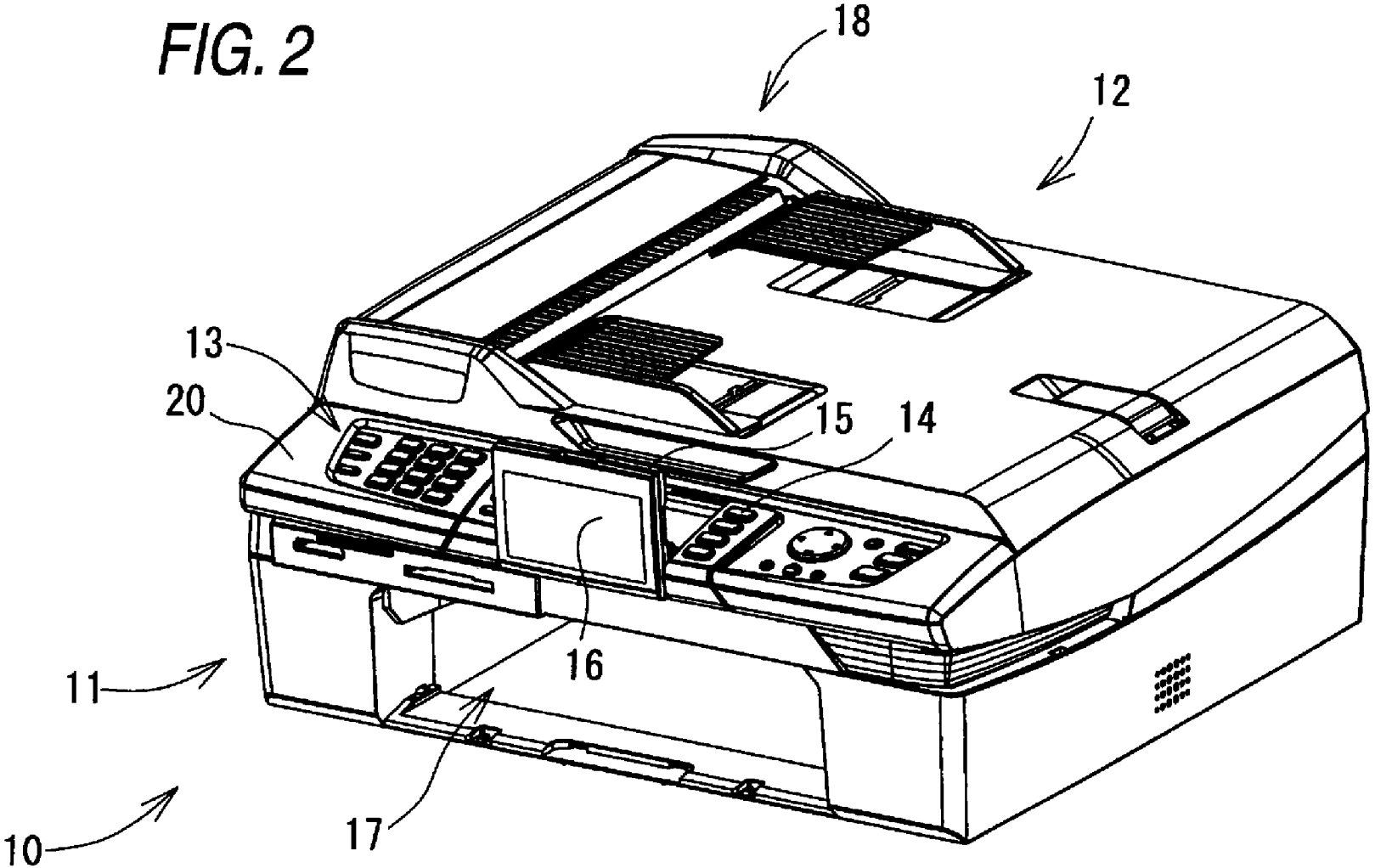
FIG. 2 is a perspective view showing an appearance configuration of the multi function device in a state of setting a touch panel body in a second posture.
Figure 3:
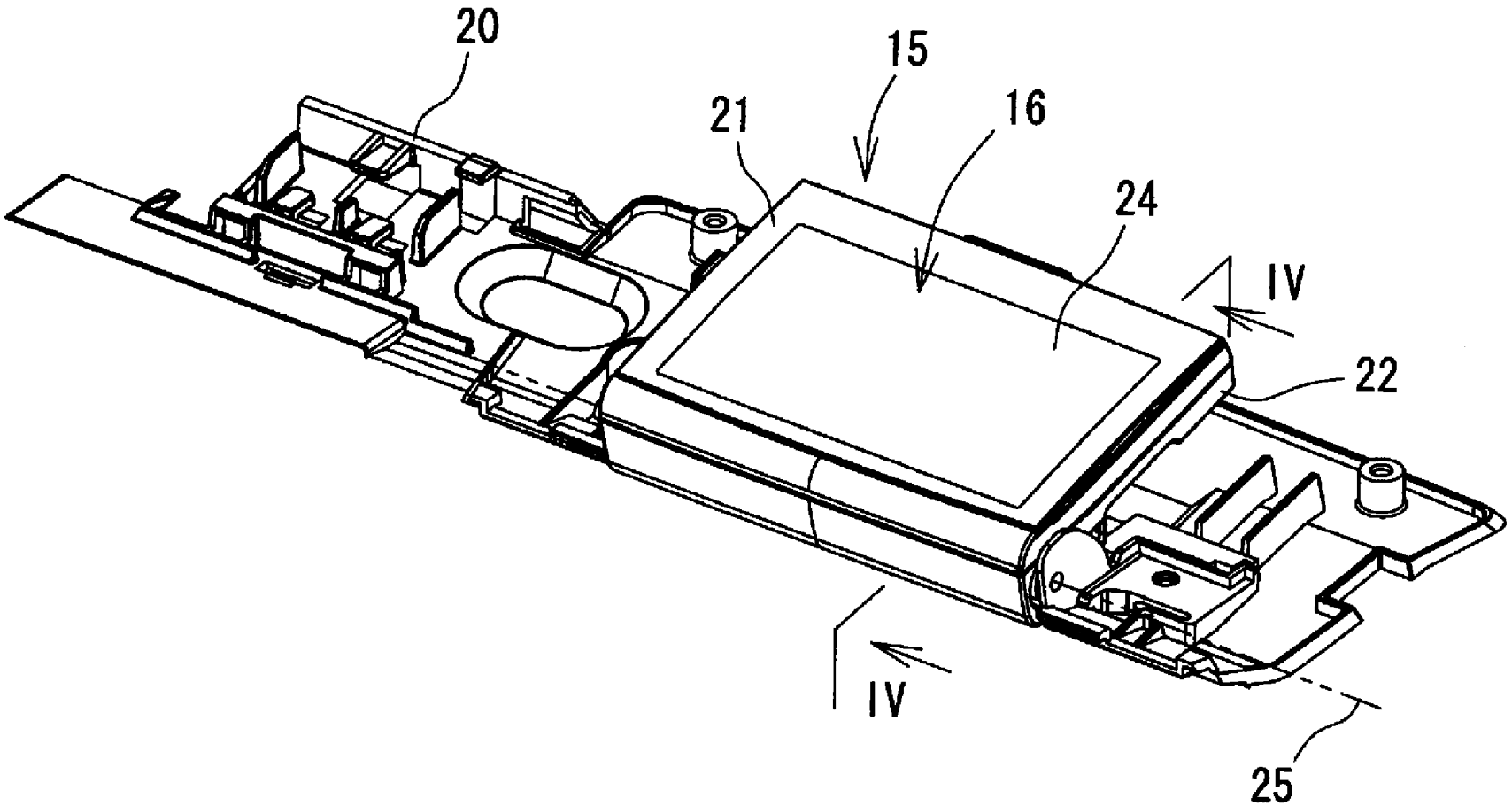
FIG. 3 is a perspective view showing a structure of coupling between the touch panel body and a body.
Figure 4:
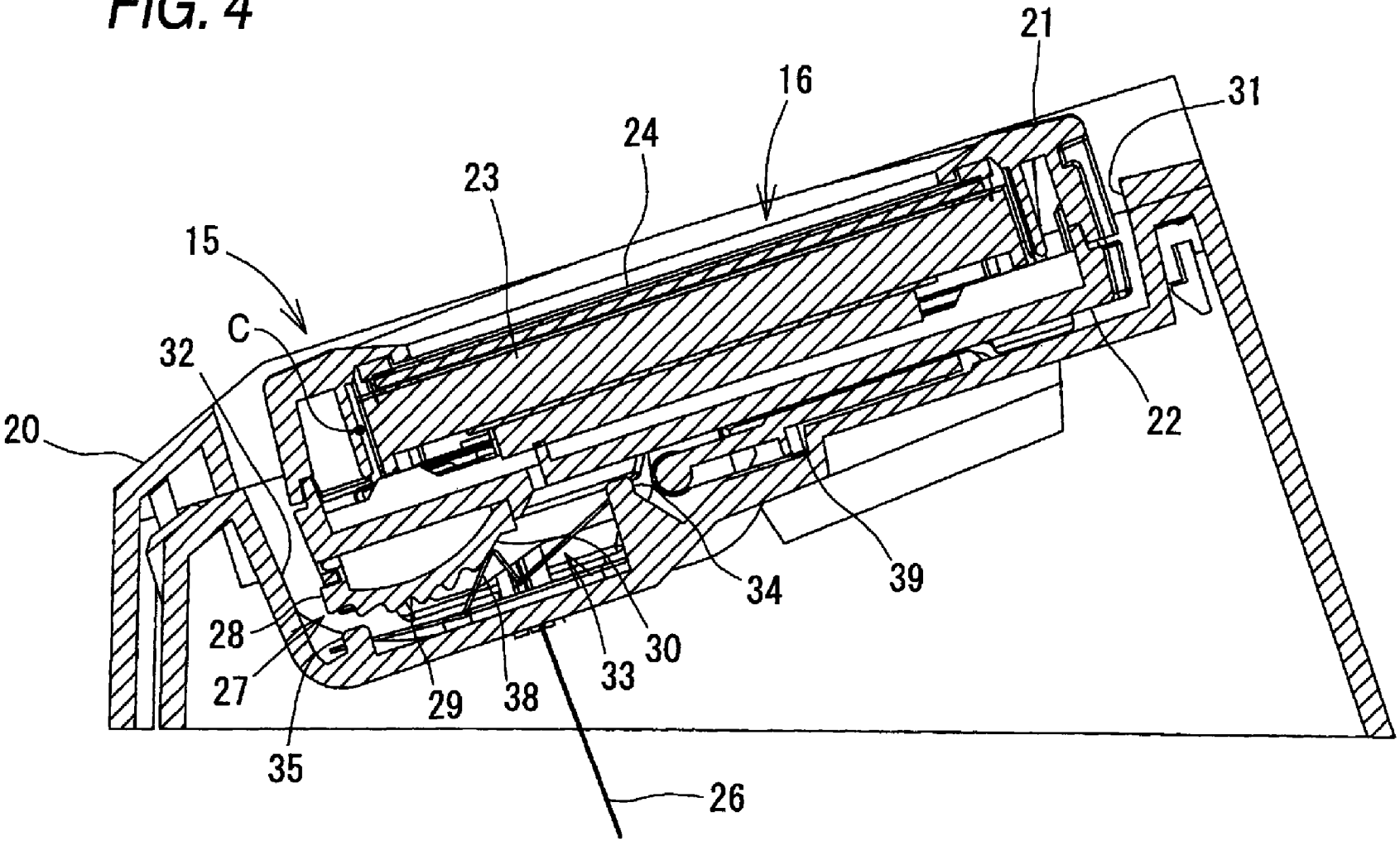
FIG. 4 is a cross-sectional view taken along a line IV-IV in FIG. 3.
Figure 5:
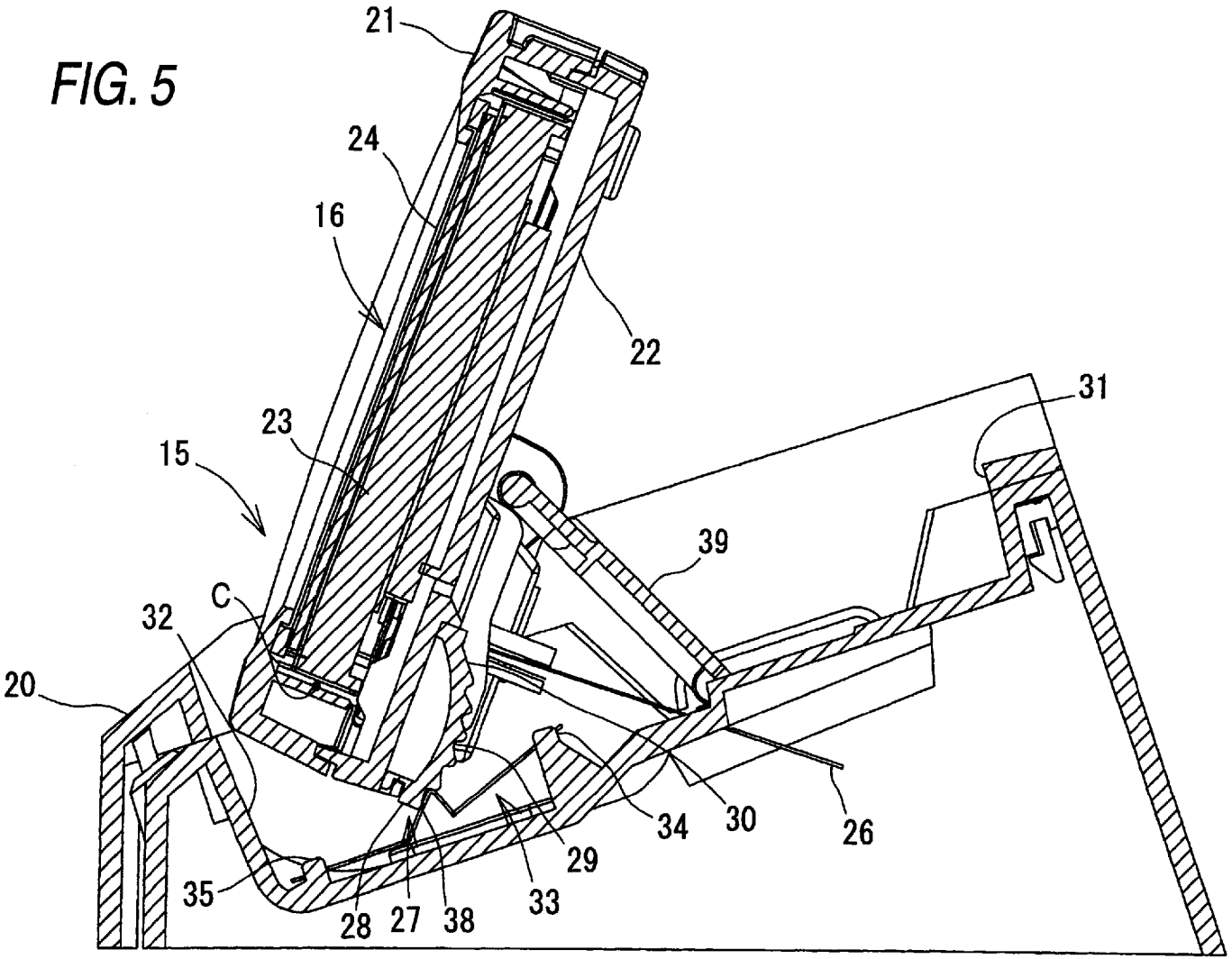
FIG. 5 is a cross-sectional view showing taken along the line IV-IV in the second posture.
Figure 6:
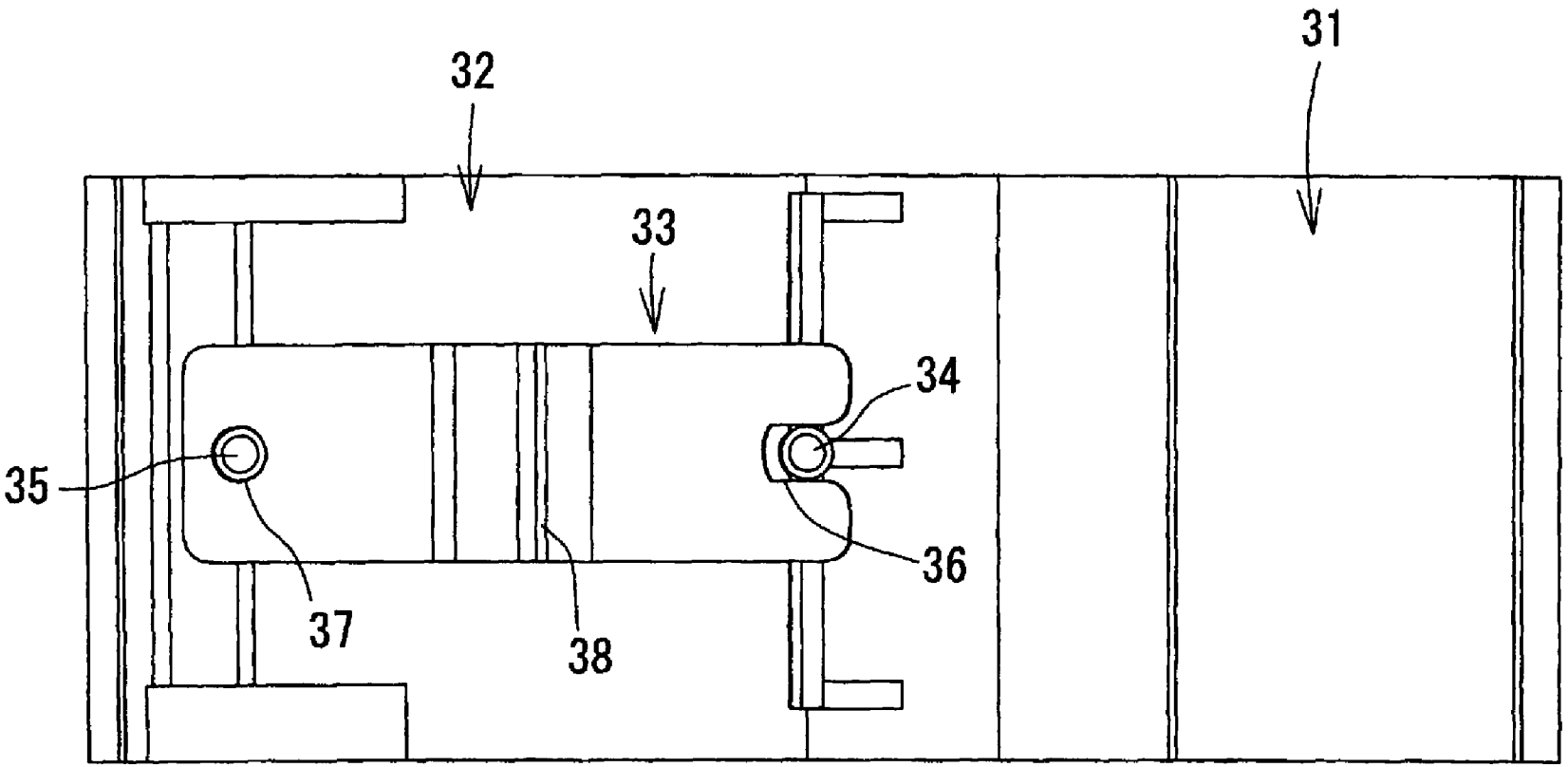
FIG. 6 is a plan view showing a support structure of a leaf spring.
Figure 7:
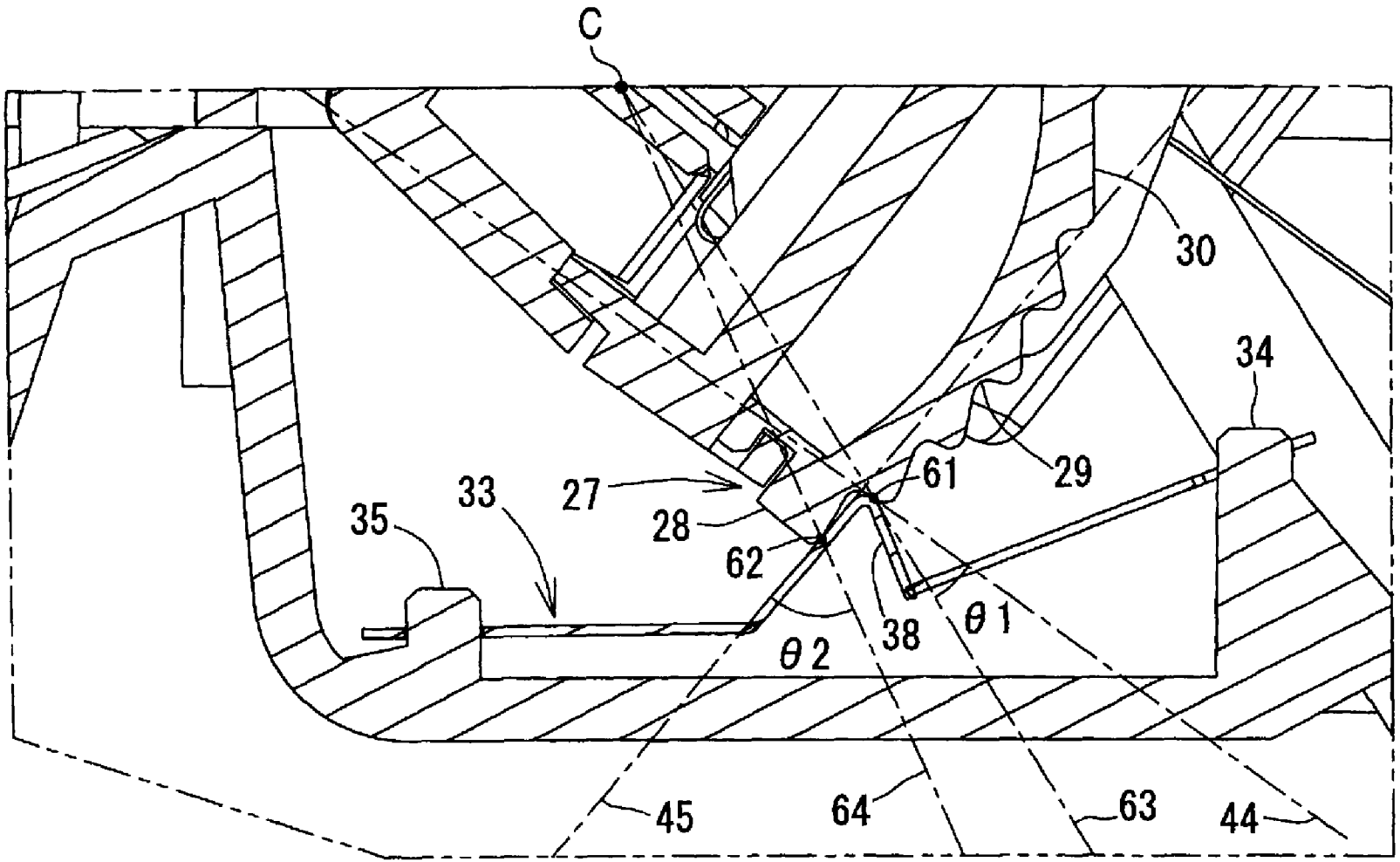
FIG. 7 is a partially enlarged view showing the portion of engagement between a pawl portion and a recessed groove in FIG. 5.
Figure 8A:
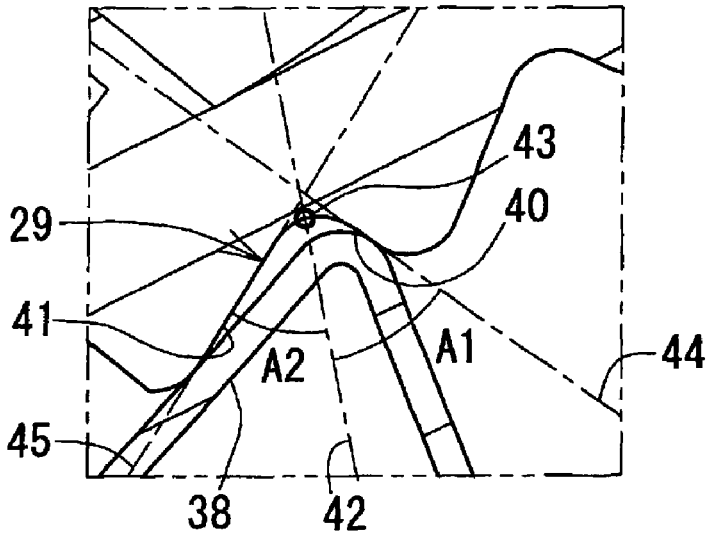
FIGS. 8A and 8B are partially enlarged views showing the portion of engagement between the pawl portion and the recessed groove in cross-section taken along the line IV-IV.
Figure 8B:
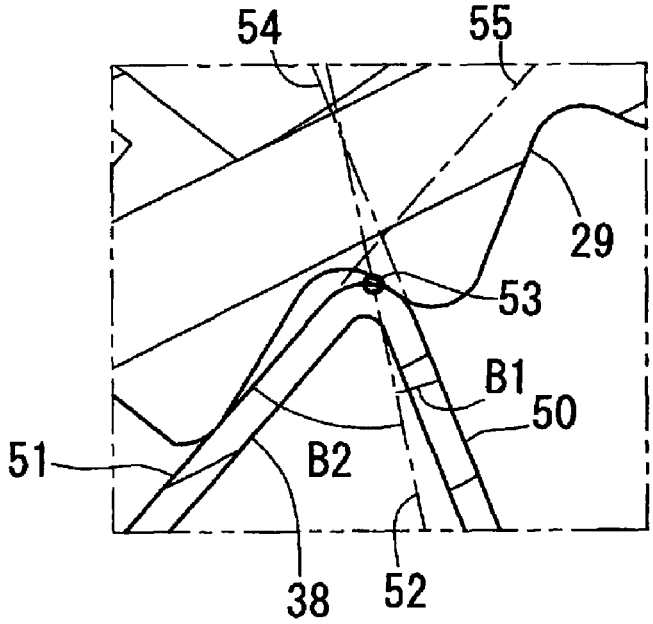

FIG. 1 is a perspective view showing an appearance configuration of a multi function device 10 according to an embodiment of the invention. FIG. 2 is a perspective view showing an appearance configuration of the multi function device 10 in a state of setting a touch panel body 15 in a second posture. FIG. 3 is a perspective view showing a structure of coupling between the touch panel body 15 and a main body 20. FIG. 4 is a cross-sectional view taken along the line IV-IV in FIG. 3. FIG. 5 is a cross-sectional view taken along the line IV-IV in the second posture. FIG. 6 is a plan view showing a support structure of a leaf spring 33. FIG. 7 is a partially enlarged view showing the portion of engagement between a pawl part 38 and a recessed groove 29 in FIG. 5. FIGS. 8A and 8B are partially enlarged views showing the portion of engagement between the pawl part 38 and the recessed groove 29 in cross-section taken along the line IV-IV. In addition, the cross-section taken along the line IV-IV corresponds to cross-section orthogonal to a rotation axis and is a plane orthogonal to the rotation axis 25.

[Multi Function Device 10]

As shown in FIG. 1, the multi function device 10 includes a printer unit 11 in a lower portion and a scanner unit 12 in an upper portion, and has a print function, a scan function, a copy function and a facsimile function. The multi function device 10 serves as an example of an image recording device. Also, the printer unit 11 in the multi function device 10 may serve as an example of an image recording device. Therefore, the image recording device may be implemented as, for example, a printer having only a print function.

The multi function device 10 is connectable to external information devices such as a computer or a digital camera, and records an image or a document on a record sheet based on print data sent from the external information device. Also, various storage media such as a memory card can be mounted to the multi function device 10. Data such as image data stored on the storage media are read out, and the image can be recorded on the record sheet.

An operation unit 13 is disposed on an upper surface of the front surface side of the multi function device 10. The operation unit 13 is provided at a main body 20 and includes various operation keys 14 and a touch panel body 15. The operation keys 14 are disposed on a surface of the main body 20 and protrude substantially upward. Therefore, a user can operate the various operation keys 14 from the upper portion of the operation unit 13. The touch panel body 15 falls to flush with an upper surface of the main body 20 in a first posture, and an operation area 16 of the touch panel body 15 faces substantially upward in the first posture. The user can input a desired command using the operation unit 13. The multi function device 10 receives a predetermined input and performs a predetermined action. The multi function device 10 is connectable to a computer and operates by a command sent from the computer through a printer driver or a scanner driver, in addition to the command input from the operation unit 13. This operation unit 13 serves as an example of an operation device, and the touch panel body 15 serves as an example of operation panel body. The operation panel body is a structural body having an operation area in which a predetermined operation is performed by an operation button, a touch panel, etc.

In the embodiment, the operation device is implemented as the operation unit 13 of the multi function device 10, but the operation device is not limited to the multi function device 10, and can be implemented in a printer, a scanner, a copy machine, a telephone, a facsimile machine, a computer, etc.

An opening 17 is formed in the front surface side of the multi function device 10. A paper feed tray and a paper discharge tray (not shown) are disposed inside the device through the opening 17 to accommodate a record sheet on which an image is recordable by the printer unit 11. A various techniques such as an ink-jet method, a laser method or a thermal method can be adopted as recording on the record sheet by the printer unit 11. In addition, FIGS. 1 and 2 show the multi function device 10 in a state of removing the paper feed tray and the paper discharge tray. The scanner unit 12 includes an auto document feeder (hereinafter called an "ADF") 18 in an FBS (Flatbed Scanner). In the FBS, an image scanner such as a CIS (Contact Image Sensor) is configured to move with respect to a platen on which a document is placed. In addition, a known configuration can arbitrarily be adopted as an internal configuration of the scanner unit 12 and the printer unit 11, so that detailed description is herein omitted.

[Operation Unit 13]

The operation unit 13 of the multi function device 10 will hereinafter be described in detail. As shown in FIG. 1, the operation unit 13 is provided at a part of the upper surface in the front surface side of the multi function device 10. The operation unit 13 has a laterally long shape with substantially the same width as a width of the multi function device 10. The main body 20 of the operation unit 13 is formed integrally with a casing of the multi function device 10, and various operation keys 14 and the touch panel body 15 are disposed on an upper surface of the main body 20.

The touch panel body 15 has a laterally long rectangle in plan view, and its longitudinal dimension is smaller than a depth dimension of the operation unit 13. As shown in FIG. 1, the touch panel body 15 falls with respect to the main body 20 such that a surface including the operation area 16 is flush with the upper surface of the main body 20. A posture of this touch panel body 15 is called a first posture in the present specification. On the other hand, as shown in FIG. 2, the touch panel body 15 is rotatable so as to rise with respect to the main body 20. This posture of the touch panel body 15 shown in FIG. 2 is called a second posture in the present specification. The touch panel body 15 is rotated between the first posture and the second posture by a tilt mechanism and can also be maintained in any posture where a leaf spring 33 engages with a latch member 27 (see FIG. 5). Therefore, a user of the multi function device 10 can change a posture of the touch panel body 15 in any posture with the best visibility or operability of the touch panel body 15.

As shown in FIG. 4, the touch panel body 15 includes an upper cover 21 and a lower cover 22 defining a cabinet of the touch panel body 15, a touch panel module 23 (hereinafter also called a "TP module 23"), and a transparent cover 24 for covering an opening of the center of the upper cover 21. Apart in which the TP module 23 is exposed from the upper cover 21 through the transparent cover 24 serves as to the operation area 16.

The lower cover 22 has substantially a dish shape and a rectangular shape in plan view, and the lower cover 22 defines side surfaces and a back surface of the touch panel body 15. Although not shown in each of the drawings in detail, bearings are formed at both sides of the device front surface side of the lower cover 22, and a pair of shafts substantially horizontally disposed at the side of the main body 20 is respectively fitted to the bearing. A rotation axis of the touch panel body 15 formed by the shafts and the bearings is shown as a rotation axis 25 in FIG. 3. The touch panel body 15 is supported by the main body 20 and rotatable around this rotation axis 25. Also, although not shown in each of the drawings, a through hole is formed in the lower cover 22, and a flat cable 26 for electrically connecting the TP module 23 to a control substrate of the multi function device 10 is led out of the touch panel body 15 through this through hole.

The upper cover 21 has a rectangle substantially similar to plan view of the lower cover 22 in plan view, and defines side surfaces and a front surface of the touch panel body 15. A combination of the upper cover 21 and the lower cover 22 defines a cabinet with substantially a rectangular parallelepiped having internal space capable of accommodating the TP module 23. An opening corresponding to a screen of the TP module 23 is formed in a surface of the upper cover 21. The screen of the TP module 23 accommodated in the internal space of the cabinet formed by the upper cover 21 and the lower cover 22 is exposed from this opening.

The transparent cover 24 is a sheet with a rectangle shape larger than the opening of the upper cover 21 in plan view. The transparent cover 24 is made of a flexible material having translucency. A user can visually identify display of the TP module 23 through the transparent cover 24 and can apply pressing force in a predetermined place of the TP module 23. This TP module 23 is configured to, when the predetermined place is pressed from outside, e.g., by a finger, detect a physical change amount in the predetermined place and convert the pressing force into a predetermined input signal. Various methods for detecting its physical change amount, such as a resistance film method, an optical method, a capacitance method, an ultrasonic method, an electromagnetic induction method, is applicable to the TP module 23. Since a known structure may be applied to the TP module 23, detailed description is herein omitted.

A protective cover 39 is disposed in the lower cover 22. The protective cover 39 has a flat plate shape with substantially the same width as that of the lower cover 22. One end side of the protective cover 39 is rotatably attached to the lower cover 22 and the other end side is slidably attached to the main body 20. The protective cover 39 rises and falls with the rotation of the touch panel body 15 and covers a tilt mechanism and the flat cable 26.

[Tilt Mechanism]

A tilt mechanism capable of maintaining the touch panel body 15 at a desired rotation angles will hereinafter be described in detail. This tilt mechanism includes the latch member 27 and the leaf spring 33. In FIGS. 4, 5 and 7, a position corresponding to the rotation axis 25 is shows as a point "C."

As shown in FIGS. 4 and 5, the latch member 27 is disposed in the lower cover 22. The latch member 27 is fixed to the lower cover 22 on the device front surface side and on the back surface side of the touch panel body 15, that is, opposite to the operation area 16. Therefore, the latch member 27 rotates together with the touch panel body 15. The latch member 27 includes a base 28 with a circular arc shape around the rotation axis 25 of the touch panel body 15, and plural recessed grooves 29 formed in an outer circumferential surface of the base 28 and recessed in a radial direction of the rotation axis 25. The recessed grooves 29 have substantially V shapes and are formed in the base 28 such that the recessed grooves 29 are continuously juxtaposed radially along a circumferential direction of the rotation axis 25. In the embodiment, five recessed grooves 29 are formed in the base 28, but the number of recessed grooves 29 can properly be selected according to the number of stepwise postures of the touch panel body 15.

The recessed grooves 29 are not formed in all the outer circumferential surface of the base 28, and a circumferential surface 30 is disposed on the device back side of the outer circumferential surface of the base 28. This circumferential surface 30 is inclined in a direction proximate to the rotation axis 25 from the boundary with the adjacent recessed groove 29 toward the device back side. As described below, a pawl portion 38 of the leaf spring 33 abuts on the circumferential surface 30 in a first posture in which the touch panel body 15 is accommodated in a recessed portion 31.

As shown in FIG. 8A, two inclined surfaces 40, 41 having substantially a V shape of each recessed groove 29 are asymmetrical with respect to an imaginary line 42 in cross-sectional view taken along the line IV-IV. In addition, five recessed grooves 29 have the same shape except that arrangement with respect to the rotation axis 25 differs, so that one recessed groove 29 will herein be described in detail. The imaginary line 42 is a straight line connecting the rotation axis 25 (see FIG. 3) and a vertex 43 of the substantially V-shaped recessed groove 29. When an imaginary line 44 along the inclined surface 40 and an imaginary line 45 along the inclined surface 41 are herein drawn, a relation of A1<A2 is satisfied where the angle A1 is defined between the imaginary line 42 and the imaginary line 44, and the angle A2 is defined between the imaginary line 42 and the imaginary line 45. Then, A1 is not equal to A2, so that the two inclined surfaces 40, 41 are asymmetrical with respect to the imaginary line 42.

As shown in FIGS. 4 and 5, the recessed portion 31 configured to accommodate the touch panel body 15 of the first posture is formed in the main body 20. The recessed portion 31 is space caved from an upper surface of the main body 20 and is formed in a shape mainly along the back surface side of the touch panel body 15. Also, a region 32 corresponding to the latch member 27 in the recessed portion 31 is caved more deeply. A surface including the operation area 16 in the touch panel body 15 is substantially flush with the upper surface of the main body 20 in a state where the touch panel body 15 of the first posture is fully accommodated in this recessed portion 31, and a rear surface of the touch panel body 15 contacts with the recessed portion 31.

As shown in FIG. 6, the leaf spring 33 is disposed in the region 32 of the recessed portion 31. A pair of pins 34, 35 protruding upward is disposed in the region 32. The pair of pins 34, 35 is separated in a depth direction of the device (a direction vertical to a sheet face of FIG. 6), and a separation distance between the pins 34, 35 is set in correspondence with a dimension of a longitudinal direction of the leaf spring 33. The leaf spring 33 is locked in the pins 34, 35, and the leaf spring 33 is fixed in the region 32 such that its longitudinal direction corresponds to the depth direction of the device. A notch 36 and a hole 37 are respectively formed at both end portions of the longitudinal direction of the leaf spring 33. The leaf spring 33 is fixed at a predetermined position of the region 32 by engaging the pin 34 with the notch 36 and inserting the pin 35 into the hole 37. This leaf spring 33 is fixed to extend in a two-dimensional direction (substantially a vertical direction and substantially a horizontal direction in FIG. 6) along a bottom surface of the region 32. The leaf spring 33 in this fixed state can be elastically deformed in a direction of contact and separation between the latch member 27 and the pawl portion 38 (a direction substantially perpendicular to the paper face of FIG. 6). The fixed position of the leaf spring 33 is set by a relation with each of the recessed grooves 29 of the latch member 27.

The center of the longitudinal direction of the leaf spring 33 is bent in substantially a V shape upward and the pawl portion 38 is formed. As described above, the leaf spring 33 fixed in the region 32 urges the pawl portion 38 into pressure contact with the latch member 27 at a predetermined position of the circumferential direction of the rotation axis 25. When the latch member 27 rotates together with the touch panel body 15, the pawl portion 38 can engage with and disengage from the recessed groove 29 of the latch member 27. The leaf spring 33 elastically urges the pawl portion 38 toward the side of the latch member 27 while the pawl portion 38 contacts with the latch member 27. The pawl portion 38 serves as an example of a pawl member, and the leaf spring 33 serves as an example of an urging member. In addition, in the embodiment, the pawl member and the urging member are integrally formed by one leaf spring 33, but it is not always necessary to integrally form these members and, for example, a pawl member may be formed as a separate component urged toward the latch member 27 by a leaf spring.

As shown in FIG. 8B, two inclined surfaces 50, 51 having substantially a V shape of the pawl portion 38 are asymmetrical with respect to an imaginary line 52 in cross-section taken along the line IV-IV. The imaginary line 52 is a straight line connecting the rotation axis 25 (see FIG. 3) and a vertex 53 of the substantially V-shaped pawl portion 38. When an imaginary line 54 along the inclined surface 50 and an imaginary line 55 along the inclined surface 51 are herein drawn, a relation of B1<B2 is satisfied, where the angle B1 is defined between the imaginary line 52 and the imaginary line 54, and the angle B2 is defined between the imaginary line 52 and the imaginary line 55. Then, B1 is not equal to B2, so that the two inclined surfaces 50, 51 are asymmetrical with respect to the imaginary line 52.

As shown in FIG. 7, the pawl portion 38 is elastically urged by the leaf spring 33 and contacts and engages at a first position 61 and a second position 62 of the recessed groove 29. Each of the recessed grooves 29 has the same shape except that arrangement with respect to the rotation axis 25 differs, so that an engagement state of the pawl portion 38 will be described using one recessed groove 29 as an example.

The first position 61 is a position in which a contact pressure increases when the touch panel body rotates toward the first posture side. The change in the posture of the touch panel body 15 toward the first posture side corresponds to the rotation of the touch panel body in a clockwise direction in the cross-section taken along the line IV-IV shown in FIGS. 4, 5, 7 and 8. In that case, the pawl portion 38 is pressed by the inclined surface 40 (see FIG. 8A) of the recessed groove 29 having the first position 61 toward a direction to be separated from the recessed groove 29. Since the pawl portion 38 is elastically urged by the leaf spring 33 in a direction of engaging with the recessed groove 29, it is necessary to move the pawl portion 38 against elastic urging of the leaf spring 33 in order to separate the pawl portion 38 from the recessed groove 29. In that case, a pressure of contact between the pawl portion 38 and the recessed groove 29 in the first position 61 increases.

The second position 62 is a position in which a contact pressure increases when the touch panel body 15 rotates toward the second posture side. The change in the posture of the touch panel body 15 toward the second posture side corresponds to the rotation of the touch panel body 15 in a counterclockwise direction in the cross-section taken along the line IV-IV. In that case, the pawl portion 38 is pressed by the inclined surface 41 (see FIG. 8A) of the recessed groove 29 having the second position 62 toward a direction to be separated from the recessed groove 29. Since the pawl portion 38 is elastically urged in a direction of engaging with the recessed groove 29 by the leaf spring 33, it is necessary to move the pawl portion 38 against elastic urging of the leaf spring 33 in order to separate the pawl portion 38 from the recessed groove 29. In that case, a pressure of contact between the pawl portion 38 and the recessed groove 29 in the second position 62 increases.

As described above, the recessed grooves 29 and the pawl portion 38 have the substantially V shape. The V shape is a recessed shape defined by intersecting two inclined surfaces at a predetermined angle and is approximated to the V shape when viewed from the cross-section or the side. However, the two inclined surfaces may be a plane surface or a curved surface or these combinations. Also, the so-called R processing or rounding processing may be performed in the bottom portion or vertex at which two inclined surfaces intersect.

Here, in section view taken along the line IV-IV, an angle θ1 is defined as an angle between: an imaginary line 63 connecting the rotation axis 25 (see FIG. 3) and the first position 61 in a state of engaging the pawl portion 38 with the recessed groove 29; and the imaginary line 44 along the inclined surface 40 of the side of the first position 61 in the recessed groove 29. Also, an angle θ2 is defined as an angle between: an imaginary line 64 connecting the rotation axis 25 and the second position 62; and the imaginary line 45 along the inclined surface 41 of the side of the second position 62 in the recessed groove 29. The angles θ1 and θ2 have a relation of $0° < \theta 1 < \theta 2 < 90°$. The imaginary line 63 serves as an example of a first imaginary line, the imaginary line 44 serves as an example of a second imaginary line, the imaginary line 64 serves as an example of a third imaginary line, and the imaginary line 45 serves as an example of a fourth imaginary line.

[Rotation Action of Touch Panel Body 15]

As shown in FIG. 4, when the touch panel body 15 is in the first posture, the pawl portion 38 of the leaf spring 33 does not engage with all the five recessed grooves 29 and pressure contacts with the circumferential surface 30 of the base 28. In order to rotate the touch panel body 15 of the first posture in a direction toward the second posture, it is necessary to elastically deform the leaf spring 33 and move the pawl portion 38 toward the radial outside of the rotation axis 25 along the circumferential surface 30. Also, because gravity acts on the touch panel body 15 in a direction of rotating the touch panel body 15 in the first posture, it is necessary to apply external force (rotational force) against the gravity to the touch panel body 15 in order to rotate the touch panel body 15 of the first posture in a direction toward the second posture. In other words, the touch panel body 15 does not rotate from the first posture without the external force applied to the touch panel body 15 against the gravity and such a leaf spring 33. The touch panel body 15 can adopt any rotation posture with a rotatable range of the touch panel body 15 at which the pawl portion 38 of the leaf spring 33 pressure contacts with the circumferential surface 30 of the base 28. Therefore, in the vicinity of the first posture, the touch panel body 15 maintains the first posture by the gravity and the leaf spring 33 described above, and also a surface of the touch panel body 15 including the operation area 16 flush with as an upper surface of the upper cover 21 of the main body 20.

When the touch panel body 15 of the first posture is rotated toward the second posture side, the leaf spring 33 is elastically deformed by rotational force applied to the touch panel body 15, and the pawl portion 38 moves toward the radial outside of the rotation axis 25 along the circumferential surface 30. When the pawl portion 38 exceeds the boundary between the recessed groove 29 and the circumferential surface 30, the pawl portion 38 is elastically restored to the radial inside of the rotation axis 25 and engages with the recessed groove 29 adjacent to the circumferential surface 30. In the case of rotating the touch panel body 15 from this state toward any of the first posture side or the second posture side, it is necessary to separate the pawl portion 38 from the recessed groove 29. For that separation, it is necessary to move the pawl portion 38 toward the radial outside of the rotation axis 25 against elastic urging of the leaf spring 33. Therefore, unless force of further rotation is applied to the touch panel body 15, the touch panel body 15 is maintained at the rotation angle in a state where the pawl portion 38 engages with the recessed groove 29.

When the touch panel body 15 is further rotated, the leaf spring 33 is elastically deformed, and the pawl portion 38 moves toward the radial outside of the rotation axis 25. Then, when the pawl portion 38 reaches the boundary between the recessed grooves 29, the pawl portion 38 is separated from the recessed groove 29 engaging previously. Substantially concurrently with this separation, the pawl portion 38 starts to engage with the next adjacent recessed groove 29 by elastic urging of the leaf spring 33. In this process, the pawl portion 38 moves toward the radial inside of the rotation axis 25, and this movement receives the elastic urging of the leaf spring 33. Therefore, rotation of the touch panel body 15 from the boundary between the recessed grooves 29 to engagement with the next recessed groove 29 can be performed by considerably smaller force than the case of separating the pawl portion 38 from the recessed groove 29. Then, when the pawl portion 38 engages with the next recessed groove 29, the touch panel body 15 is maintained at the rotation angle unless force of further rotation is applied to the touch panel body 15 as described above. By such engagement between the recessed groove 29 and the pawl portion 38, postures of the touch panel body 15 are maintained at any of circumferentially stepwise rotation positions. Then, in the case of moving the stepwise rotation positions, elastic deformation and restoration of the leaf spring 33 are continuously performed with disengagement and engagement between the recessed groove 29 and the pawl portion 38, and a click feeling is generated in rotation of the touch panel body 15.

Also, as shown in FIG. 7, the pawl portion 38 pressure contacts with the first position 61 and the second position 62 of the recessed groove 29 in a state where the pawl portion 38 engages with the recessed groove 29. Then, the angles θ1 and θ2 have a relation of $0° < \theta 1 < \theta 2 < 90°$ as described above. A ratio, at which rotational force applied to the touch panel body 15 is converted into force of moving the pawl portion 38 to the radial outside of the rotation axis 25 (a direction of being separated from the recessed groove 29), varies depending on the angles θ1 and θ2. That is, as the angles θ1 and θ2 decrease, force of moving the pawl portion 38 to the radial outside of the rotation axis 25 decreases with respect to force of rotating the touch panel body 15.

Therefore, rotational force F1 necessary to separate the pawl portion 38 from the recessed groove 29 against the leaf spring 33 and to change the posture of the touch panel body 15 toward the first posture side is greater than rotational force F2 necessary to change a posture of the touch panel body 15 toward the second posture side in a similar manner ($F1 > F2$). Consequently, the touch panel body 15 can relatively easily rotates toward the second posture side, but does not rotate toward the first posture side when greater rotational force is not applied. That is, by a pressing operation applied to the operation area 16, the touch panel body 15 does not rotate easily even when force of rotating the touch panel body 15 toward the first posture side is applied.

Another Embodiment

In the above embodiment, the recessed grooves 26 are formed at the touch panel body 15, and the leaf spring 33 including the pawl portion 38 is provided at the main body 20. However, the present invention is not limited thereto. For example, the recessed grooves 26 may be formed at the main body 20, and the leaf spring 33 including the pawl portion 38 may be provided at the touch panel body 15. In other words, the recessed grooves may be provided at the main body, and the pawl member and the urging member may be provided at the operation panel body.

Effect of Embodiments

According to the operation unit 13 of the embodiments, since the posture of the touch panel body 15 can be changed, the device can be thinned, especially at the first posture. Also, the multi function device 10 is thinned by disposing the operation unit 13 on an upper surface of the multi function device 10 as described in the embodiments.

Also, the tilt mechanism allows the touch panel body 15 to set at maintain in any of postures. Further, according to this tilt mechanism, force F1 necessary to rotate the touch panel body 15 toward the first posture side becomes greater with respect to force F2 necessary to rotate the touch panel body 15 toward the second posture side, so that the touch panel body 15 which is relatively easy to rise and is resistant to falling during an operation to the operation area 16 is implemented.

Each of the recessed groove 29 and the pawl portion 38 is shaped such that a surface asymmetrical with respect to each of the imaginary lines 42, 52 connecting each of the V-shaped vertexes 43, 53 and the rotation axis 25 in the cross-section taken along IV-IV, which allows easy design of the angles θ1 and θ2 at arbitrary angles while sufficiently ensuring a depth of the recessed groove 29. By ensuring the depth of the recessed groove 29, force necessary to rotate the touch panel body 15 can increase and also a click feeling with rotation can increase. Also, the angles θ1 and θ2 can be designed at arbitrary angle and thereby, a ratio between forces F1 and F2 can be designed widely.

What is claimed is:

1. An operation device comprising:

a main body;

an operation panel body attached to the main body rotatably around a rotation axis, such that a rotation of the operation panel body allows a posture of the operation panel body to change to take a first posture falling with respect to the main body and a second posture rising with respect to the main body, and a tilt mechanism configured to maintain the operation panel body at predetermined rotation angles, wherein the tilt mechanism comprises:

a plurality of substantially V-shaped recessed grooves formed at one of the operation panel body and the main body, the recessed grooves recessed in a radial direction of the rotation axis of the operation panel body and arranged along a circumferential direction of the rotation axis;

a substantially V-shaped pawl member provided at the other of the operation panel body and the main body, the pawl member configured to engage with and disengage from the recessed groove at a predetermined position of the circumferential direction of the rotation axis; and an urging member provided at the other of the operation panel body and the main body, the urging member configured to elastically urge the pawl member in a direction that the pawl member engages with the recessed groove, wherein, when the pawl member is urged by the urging member and engages with the recessed groove, the pawl member contacts with the recessed groove at a first position and a second position, the first position at which a contact pressure in the recessed groove increases in case where the operation panel body rotates toward the first posture side, and the second position at which a contact pressure in the recessed groove increases in case where the operation panel body rotates toward the second posture side, and wherein a following relationship is satisfied:

$$0° < \theta 1 < \theta 2 < 90°$$

where, in cross-section orthogonal to the rotation axis, an angle θ1 is defined between: a first imaginary line connecting the first position and the rotation axis; and a second imaginary line along an inclined surface of the first position side in the recessed groove, and an angle θ2 is defined between: a third imaginary line connecting the second position and the rotation axis; and a fourth imaginary line along an inclined surface of the second position side in the recessed groove.

2. The operation device according to claim 1, wherein each of the recessed groove and the pawl member respectively has a first surface and a second surface which define the substantially V-shape, the first surface and the second surface being asymmetrical with respect to a line connecting vertex of the substantially V-shape and the rotation axis in the cross-section.

3. The operation device according to claim 1, wherein the operation panel body comprises a touch panel which allows an input in a direction of rotation of the operation panel body.

4. The operation device according to claim 3, wherein the touch panel comprises an operation area substantially perpendicular to the tangent to the circumferential direction of the rotation axis in the cross-section.

5. The operation device according to claim 1, wherein the main body has a recessed portion, and wherein the tilt mechanism is provided in the recessed portion.

6. The operation device according to claim 5, wherein an upper surface of the operation panel body is substantially flush with an upper surface of the main body when the operation panel body is in the first posture.

7. The operation device according to claim 1, wherein the recessed grooves are provided at the main body, wherein the pawl member and the urging member are provided at the operation panel body.

8. The operation device according to claim 7, wherein the main body has a circumferential surface extending in the circumferential direction of the rotation axis in the cross-section, and wherein the recessed grooves are formed in the circumferential surface.

9. The operation device according to claim 1, wherein the tilt mechanism comprises a leaf spring that configures the pawl member and the urging member.

10. The operation device according to claim 9, wherein the leaf spring is bent to form a substantially V-shaped portion that corresponds to the pawl member.

11. An image recording device comprising an operation device, said operation device comprising:

a main body;

an operation panel body attached to the main body rotatably around a rotation axis, such that a rotation of the operation panel body allows a posture of the operation panel body to change to take a first posture falling with respect to the main body and a second posture rising with respect to the main body, and a tilt mechanism configured to maintain the operation panel body at predetermined rotation angles, wherein the tilt mechanism comprises:

a plurality of substantially V-shaped recessed grooves formed at one of the operation panel body and the main body, the recessed grooves recessed in a radial direction of the rotation axis of the operation panel body and arranged along a circumferential direction of the rotation axis;

a substantially V-shaped pawl member provided at the other of the operation panel body and the main body, the pawl member configured to engage with and disengage from the recessed groove at a predetermined position of the circumferential direction of the rotation axis; and an urging member provided at the other of the operation panel body and the main body, the urging member configured to elastically urge the pawl member in a direction that the pawl member engages with the recessed groove, wherein, when the pawl member is urged by the urging member and engages with the recessed groove, the pawl member contacts with the recessed groove at a first position and a second position, the first position at which a contact pressure in the recessed groove increases in case where the operation panel body rotates toward the first posture side, and the second position at which a contact pressure in the recessed groove increases in case where the operation panel body rotates toward the second posture side, and wherein a following relationship is satisfied:

$$0° < \theta 1 < \theta 2 < 90°$$

where, in cross-section orthogonal to the rotation axis, an angle $\theta 1$ is defined between: a first imaginary line connecting the first position and the rotation axis; and a second imaginary line along an inclined surface of the first position side in the recessed groove, and an angle $\theta 2$ is defined between: a third imaginary line connecting the second position and the rotation axis; and a fourth imaginary line along an inclined surface of the second position side in the recessed groove.

* * * * *